US008641827B2

(12) United States Patent
Blattner et al.

(10) Patent No.: US 8,641,827 B2
(45) Date of Patent: Feb. 4, 2014

(54) CLEANING COMPOSITION WITH SURFACE MODIFICATION POLYMER

(71) Applicant: Ecolab USA Inc., St. Paul, MN (US)

(72) Inventors: Amanda Ruth Blattner, Prior Lake, MN (US); Charles Allen Hodge, Cottage Grove, MN (US); Erin Jane Dahlquist, West St. Paul, MN (US); Mark Dennis Levitt, Lake Elmo, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 13/662,686

(22) Filed: Oct. 29, 2012

(65) Prior Publication Data

US 2013/0072419 A1 Mar. 21, 2013

Related U.S. Application Data

(63) Continuation-in-part of application No. 13/622,655, filed on Sep. 19, 2012.

(60) Provisional application No. 61/537,388, filed on Sep. 21, 2011.

(51) Int. Cl.
*B08B 3/04* (2006.01)

(52) U.S. Cl.
USPC ..... 134/25.2; 134/25.3; 134/39; 134/42; 510/197; 510/199; 510/470; 510/474; 510/475; 510/477; 510/488; 510/499; 510/504; 510/525; 424/70.11; 424/70.13; 424/70.16; 424/70.28

(58) Field of Classification Search
USPC ..... 510/197, 199, 470, 474, 475, 477, 488, 510/499, 504, 525; 424/70.11, 70.13, 424/70.16, 70.28; 134/25.2, 25.3, 39, 42
See application file for complete search history.

(56) References Cited

U.S. PATENT DOCUMENTS

| | | | |
|---|---|---|---|
| 5,030,374 | A | 7/1991 | Tranner |
| 6,569,261 | B1 | 5/2003 | Aubay et al. |
| 6,593,288 | B2 | 7/2003 | Aubay et al. |
| 6,627,612 | B1 | 9/2003 | O'Lenick, Jr. et al. |
| 6,703,358 | B1 | 3/2004 | Aubay et al. |
| 6,767,410 | B2 | 7/2004 | Aubay et al. |
| 6,881,711 | B1 | 4/2005 | Gershun et al. |
| 7,078,358 | B2 | 7/2006 | Roberts et al. |
| 7,396,808 | B1 | 7/2008 | Hood et al. |

(Continued)

FOREIGN PATENT DOCUMENTS

WO WO2007068870 A1 6/2007

OTHER PUBLICATIONS

Carechemicals, "Product Data Sheet, GLUCOPON 215 UP", 2 pages.

(Continued)

*Primary Examiner* — Brian P Mruk
(74) *Attorney, Agent, or Firm* — McKee, Voorhees & Sease, P.L.C.

(57) ABSTRACT

A cleaning composition includes water, glycerine, at least one alkyl polyglycoside and a surface modification polymer. The surface modification polymer acts to provides for initial cleaning or pretreatment of the hard surface and provides a hydrophilic coating or barrier layer on the surface which provides residual cleaning to the hard surface for an extended number of cleanings. The composition has an alkaline pH of from about 8 to 10.

20 Claims, 1 Drawing Sheet

(56) References Cited

U.S. PATENT DOCUMENTS

| | | | |
|---|---|---|---|
| 7,465,700 | B1 | 12/2008 | Ochomogo et al. |
| 7,521,413 | B2 | 4/2009 | Ochomogo et al. |
| 7,527,060 | B2 | 5/2009 | Hood et al. |
| 7,592,301 | B2 | 9/2009 | Smith et al. |
| 7,637,271 | B1 | 12/2009 | Cumberland et al. |
| 7,696,145 | B2 | 4/2010 | Kaaret |
| 7,741,265 | B2 | 6/2010 | Iverson et al. |
| 7,939,486 | B2 | 5/2011 | Scheuing et al. |
| 7,939,487 | B2 | 5/2011 | Scheuing et al. |
| 7,964,544 | B2 | 6/2011 | Smith et al. |
| 2004/0154640 | A1 | 8/2004 | Smith et al. |
| 2005/0003990 | A1 | 1/2005 | Smith et al. |
| 2005/0227898 | A1 | 10/2005 | Leskowicz et al. |
| 2006/0094626 | A1 | 5/2006 | Horton, III |
| 2006/0135394 | A1 | 6/2006 | Smith et al. |
| 2010/0160201 | A1* | 6/2010 | Scheuing et al. ..... 510/180 |
| 2011/0061680 | A1 | 3/2011 | Davister et al. |
| 2011/0098206 | A1 | 4/2011 | Lynch et al. |

OTHER PUBLICATIONS

Rhodia, "MIRAPOL SURF-S 110, Product Data Sheet E 90028633", Feb. 2011, 2 pages.

Rhodia, "MIRAPOL SURF-S 210, Product Data Sheet E 90028635", Mar. 2011, 2 pages.

"Product Data Sheet POLYQUART AMPHO 149", 1 page.

* cited by examiner

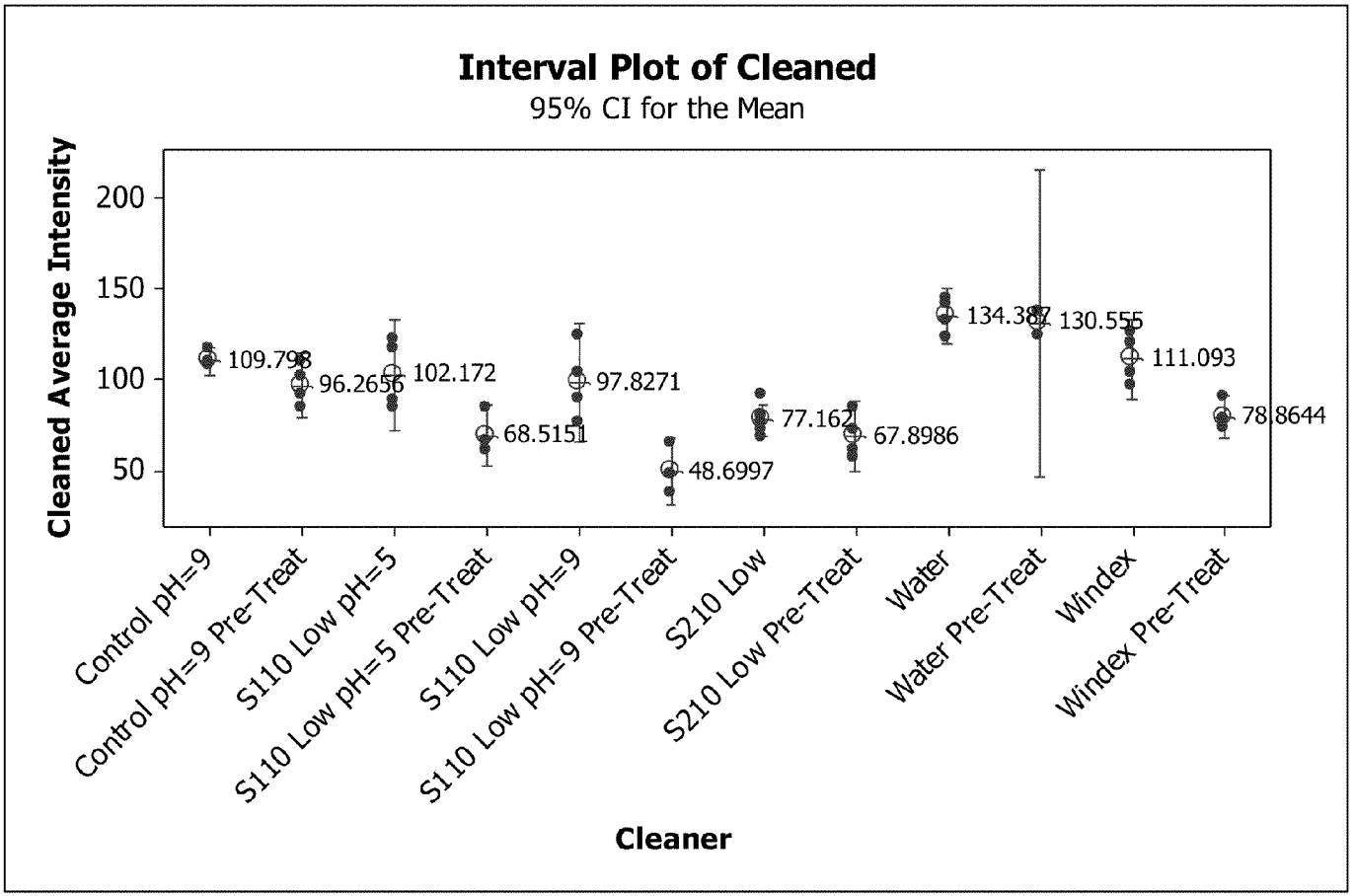
Interval Plot of Cleaned
95% CI for the Mean
Cleaned Average Intensity
200
150
100
50
109.7988
96.2656
102.172
68.5151
97.8271
48.6997
77.1672
67.8986
134.3887
130.5555
111.093
78.8644
Control pH=9
Control pH=9 Pre-Treat
S110 Low pH=5
S110 Low pH=5 Pre-Treat
S110 Low pH=9
S110 Low pH=9 Pre-Treat
S210 Low
S210 Low Pre-Treat
Water
Water Pre-Treat
Windex
Windex Pre-Treat
Cleaner

CLEANING COMPOSITION WITH SURFACE MODIFICATION POLYMER

CROSS-REFERENCE TO RELATED APPLICATIONS

This is a Continuation-in-Part application of U.S. Ser. No. 13/622,655 filed Sep. 19, 2012, pending, which claims priority to U.S. Ser. No. 61/537,388 filed Sep. 21, 2011, herein incorporated by reference in their entirety.

TECHNICAL FIELD

The present invention is related to the field of hard surface cleaning compositions. In particular, the present invention is related to bio-based cleaning compositions having a low volatile organic compound concentration and a surface modification polymer that makes the surface easier to clean after a first application.

BACKGROUND OF THE INVENTION

Hard surface cleaners, especially in the form of trigger sprays and aerosol sprays, are useful on a variety of surfaces, including surfaces such as bathroom and kitchen surfaces. Bathroom and kitchen surfaces include a variety of smooth surfaces which when clean have a glossy or shiny surface, e.g. glass, ceramic, chrome, stainless steel and the like. During use between cleanings, build-up occurs on these surfaces from soils, such as dirt, soap scum, limescale and the like. This build-up can occur quickly and result in a dull look and roughened surface texture or feel.

The composition of the invention initially cleans a hard surface and, thereafter, leaving a protective and hydrophilic coating on the hard surface that allows for easier removal of soils from the treated surface through simple rinsing with water. This hydrophilic coating remains on a treated surface for an extended period of time through numerous rinsings.

Glass cleaners are often available in a form that is ready to use. Alternatively, the glass cleaner may be provided as a concentrate solution which is diluted with dilution water to form a use solution at the point of use or at an intermediate location. Diluting the concentrate at the point of use or at an intermediate location reduces the cost and the space required to transport and store the concentrate solution.

One reason that glass cleaners are provided in a form that is ready to use is to control the presence of "hardness" in the water used to prepare the ready to use glass cleaner, which has a tendency to cause precipitation of some components of the solution, such as anionic surfactants. Water hardness may also lead to aesthetically unpleasant streaking on glass surfaces.

Hardness is defined as the concentration of multivalent cations. Typically multivalent cations include $Ca^{2+}$ and $Mg^{2+}$ ions. Iron, aluminum and manganese can also contribute to hardness. One measurement of hardness defines hardness in terms of the calcium carbonate concentration where 1 grain is equivalent to 17.1 mg of calcium carbonate per liter.

Glass cleaners also typically include a volatile organic compound (VOC) such as but not limited to solvents such as ethanol and alkanol amines such as monoethanolamine. A compound is non-volatile if its vapor pressure is below 0.1 mm Hg at 20° C. VOCs have been the subject of regulation by different government entities, the most prominent regulations having been established by the California Air Resource Board in its General Consumer Products Regulation. Thus, it may be desirable to formulate glass cleaners containing low or no VOCs.

SUMMARY OF THE INVENTION

The present invention includes a cleaning composition that includes water, glycerine, at least one alkyl polyglycoside and a cationic surface modification polymer. Applicants have surprisingly found that the cleaning composition works best at an alkaline pH in the range of 8.5 to about 9.5. This is in contravention to typical hard surface cleaners with surface modifying polymers which are acidic in nature.

In one embodiment, the present invention is a method of using a cleaning solution which includes applying the cleaning composition to a hard surface and wiping the hard surface to remove the cleaning composition.

In another embodiment, the present invention is a method of forming a use solution which includes mixing dilution water with the cleaning composition to form a use solution.

In other embodiments, the cleaning composition may be substantially free of a solvent. Further, the cleaning composition may have a low concentration of volatile organic compounds or may be substantially free of volatile organic compounds.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DESCRIPTION OF THE FIGURES

FIG. 1 is a graph of the results of the glass cleaner test method uses a scanner and image analysis software to analyze the cleaned mirrors. A lower cleaned average intensity number means a cleaner mirror. As can be seen in the graph pre-treatment of the mirrors with solution does lower the average cleaned intensity and does so considerable with the S-110 polymer at a pH of 9. The difference in non-treated versus pre-treated mirror for the S-110 polymer at pH of 9 was 49.13 and the difference in non-treated versus pre-treated mirror for Windex was 32.23.

DETAILED DESCRIPTION

Definitions

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

As used herein, "composition" refers to any liquid substance having more than one component.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of actual active ingredient in the total formula. For example, an off-the-shelf composition of Formula X may only contain 70% active ingredient X. Thus, 10 g. of the off-the-shelf composition only contains 7 g. of X. If 10 g. of the off-the-shelf composition is added to 90 g. of other ingredients, the wt. % of X in the final formula is thus only 7%.

As used herein, "hard surface" refers to any porous and/or non-porous surface. In one embodiment, a hard surface may be selected from the group consisting of: ceramic, glass, metal, polymer, stone, and combinations thereof. In another embodiment, a hard surface does not include silicon wafers and/or other semiconductor materials. Nonlimiting examples of ceramic surfaces include: toilet bowl, sink, shower, tile, the like, and combinations thereof. A nonlimiting example of a glass surfaces includes: window, mirror and the like. Nonlimiting examples of metal surfaces include: drain pipe, sink, automobiles, the like, and combinations thereof. Nonlimiting examples of a polymeric surface includes: PVC piping, fiberglass, acrylic, Corian®, the like, and combinations thereof. A nonlimiting example of a stone hard surface includes: granite, marble, and the like.

A hard surface may be any shape, size, or have any orientation that is suitable for its desired purpose. In one nonlimiting example, a hard surface may be a window which may be oriented in a vertical configuration. In another nonlimiting example, a hard surface may be the surface of a curved surface, such as a ceramic toilet bowl. In yet another nonlimiting example, a hard surface may be the inside of a pipe, which has vertical and horizontal elements, and also may have curved elements. It is thought that the shape, size and/or orientation of the hard surface will not affect the compositions of the present invention.

As used herein, "surfactant" refers to any agent that lowers the surface tension of a liquid, for example water. Exemplary surfactants which may be suitable for use with the present invention are described infra. In one embodiment, surfactants may be selected from the group consisting of anionic, nonionic, cationic, amphoteric, zwitterionic, and combinations thereof. In other nonlimiting embodiments, the surfactant may be a superwetter.

Compositions of the Invention

In one embodiment, the cleaning composition can include water, glycerine, at least one alkyl polyglycoside, a cationic surface modification polymer and optionally at least one amino-carboxylate. The cleaning composition can be substantially free of organic solvents such that the cleaning composition has a low concentration of or is substantially free of volatile organic compounds. The cleaning composition can also have a high bio-based content. Bio-based content can be determined using ASTM Method D6866, entitled Standard Test Methods for Determining the Bio-based Content of Natural Range Materials Using Radiocarbon and Isotope Ratio Mass Spectometry Analysis. More specifically, ASTM Method D6866 uses radiocarbon dating to measure the amount of new carbon present in a product as a percentage of the total organic carbon by comparing the ratio of Carbon 12 to Carbon 14. The water content of a product is not included as part of bio-based content as it contains no carbon.

As discussed further below, the cleaning composition can be diluted with water, also known as dilution water, to provide a ready to use cleaning composition. The ready to use cleaning composition may result in low streaking and little to no build up when used to clean a substrate, such as a glass substrate, even when water hardness is present. The cleaning compositions can be applied in any environment where it is desirable to have low streaking and little to no buildup, particularly when water hardness is present. For example, the cleaning composition can be used in institutional applications and vehicle care applications. Such applications include but are not limited to: surface cleaning and destaining, and kitchen and bath cleaning and destaining. A particularly suitable application is cleaning glass surfaces. Methods of using the cleaning composition are also provided.

Alkyl Polyglycoside

The cleaning composition includes a detersive amount of at least one alkyl polyglycoside. Suitable alkyl polyglycosides include but are not limited to alkyl polyglucosides and alkyl polypentosides. Alkyl polyglycosides are bio-based nonionic surfactants which have wetting and detersive properties and a generally mixtures conforming to the following structures:

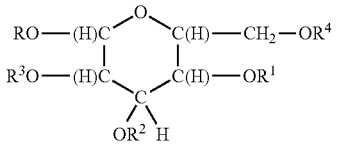

wherein; R is alkyl having 8 to 22 carbon atoms;

$R^1$, $R^2$, $R^3$ and $R^4$ are independently selected from the group consisting of $$—CH_2CH(OH)CH_2—R^{12}$$

And H, whet the proviso that $R^1$, $R^2$, $R^3$ and $R^4$ are not all H;

$R^{12}$ is selected from the group consisting of —OH,

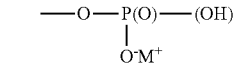

$$—SO_3^-M^+ \quad \text{and} \quad SO4^{=}2M^+,$$

M is selected from the group consisting of Na, K, and NH4, and

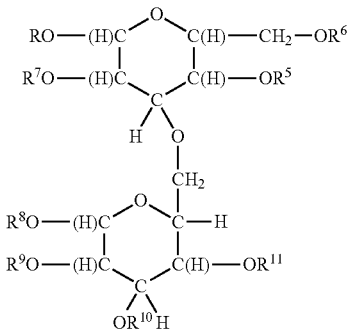

Wherein,

R is alkyl having 8 to 22 carbon atoms;

$R^1$, $R^2$, $R^3$ and $R^4$, R5, $R^5$, $R^6$, $R^7$, $R^8$, $R^9$, $R^{10}$, and $R^{11}$ are independently selected from the group consisting of —OH,

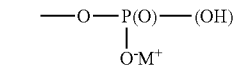

$$—SO_3^-M^+ \quad \text{and} \quad SO4^{=}2M^+,$$

M is selected from the group consisting of Na, K, and NH4,

In a preferred embodiment $R^{12}$ is —OH.

In a preferred embodiment $R^{12}$ is $—SO_3-M^+$.

In a preferred embodiment $R^{12}$ is $SO_4^{=}2M^+$.

In a preferred embodiment M is Na.

In a preferred embodiment M is K.

In a preferred embodiment M is $NH_4$.

Commercially available alkyl polyglycosides may contain a blend of carbon lengths. Suitable alkyl polyglycosides include alkyl polyglycosides containing short chain carbons, such as chain lengths of less than $C_{12}$. In one example, suitable alkyl polyglycosides include $C_8$-$C_{10}$ alkyl polyglycosides and alkyl polyglycosides blends primarily containing $C_8$-$C_{10}$ alkyl polyglycosides. Suitable commercially available alkyl polyglucosides include Glucopon 215 UP available from BASF Corporation. Alkyl polypentosides are commercially available from Wheatoleo. Suitable commercially available polypentosides include Radia®Easysurf 6781, which contains chain lengths of about $C_8$-$C_{10}$ and is available from Wheatoleo. Suitable commercially available alkyl polyglucosides include AG 6202, AG 6206 and AG 6210 available from Akzo Nobel, Simusol SL 4, Simusol SL 8, Simusol SL 10, Simusol SL 11 W, Simusol SL 55, and Simusol SL 826 available from Seppic, and Glucopon 50 G, Glucopon 225 DK, Glucopon 425 N, Glucopon 600 UP and Glucopon 625 UP available from BASF Corporation. The cleaning composition, when provided as a concentrate, can include alkyl polyglycoside in an amount sufficient to provide a use solution having desired wetting and detersive properties after dilution with water. Suitable concentrations of alkyl polyglycosides include between about 0.05% and about 50% by weight of the cleaning composition. Further suitable concentrations of alkyl polyglycosides include between about 0.05% and about 40%, between about 0.1% and about 30%, and between about 0.2% and about 20% by weight of the cleaning composition.

Glycerine

The cleaning composition further includes glycerine, a non-volatile organic compound. Glycerine functions as a glide aid or lubricant. It has been discovered that glycerine helps a cloth "glide" across a glass surface during cleaning and particularly reduce streaking when water hardness is present. In comparison, when glycerine is not present in the current cleaning composition, a cloth will pull as it is wiped across the window and results in a greater amount of streaking.

Suitable amounts of glycerine include between about 0.001% and about 30% by weight of the cleaning composition. Amounts of glycerine between about 0.01% and about 10%, between about 0.01% and about 8%, and between about 0.01% and about 5% by weight of the cleaning composition may also be suitable. Further suitable concentrations of glycerine include between about 0.01% and about 2% by weight of the cleaning composition. When applied to a hard surface at room temperature, glycerine may reduce streaking caused by hard water.

Surface Modification Polymer

The cleaning composition further includes a cationic surface modification polymer. Acidic polymers will not work in the cleaning compositions of the invention. Hydrophilic polymers suitable for use in the cleaning composition of the invention have a polyampholyte structure wherein the charge and surface adsorption are determined by pH. Hydrophilic polymers suitable for use in combination with the alkyl polyglycosidesurfactant include at least (1) an acidic monomer having or capable of forming an anionic charge and (2) a monomer having a permanent cationic charge or is capable of forming a cationic charge upon protonation. The polymer is preferably a polyampholyte. Further, the polymer is preferably an aqueous based acrylic acid amine-functional polymer. An example of such a polymer is a quaternized ammonium acrylamide acrylic acid copolymer. Hydrophilic polymers suitable for inclusion in the composition of the invention are described in U.S. Pat. Nos. 7,741,265; 6,569,261; 6,593,288; 6,703,358 and 6,767,410, the disclosures of which are incorporated herein by reference. The polymers are water-soluble or water-dispersible copolymers including, in the form of polymerized units, (1) at least one amine-functional monomer, (2) at least one hydrophilic monomer with an acidic nature and (3) optionally at least one hydrophilic monomer with ethylenic unsaturation and with a neutral charge. The copolymers include quaternized ammonium acrylamide acid copolymers. It will be appreciated that selection of appropriate relevant materials and structures as to the polymer should be guided in more detail by the teachings of these patent documents.

One example of a surface modification polymer useful in the present invention includes a water-soluble or water-dispersible copolymer comprising, in the form of polymerized units: (a) at least one monomer compound of general formula I:

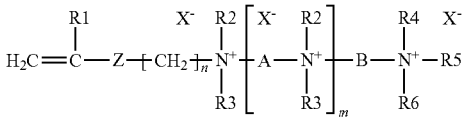

in which $R_1$ is a hydrogen atom or a methyl or ethyl group;

$R_2$, $R_3$, $R_4$, $R_5$ and $R_6$, which are identical or different, are linear or branched $C_1$-$C_6$, preferably $C_1$-$C_4$, alkyl, hydroxyalkyl or aminoalkyl groups; m is an integer from 0 to 10, preferably from 0 to 2; n is an integer from 1 to 6, preferably 2 to 4;

Z represents a—C(O)O— or —C(O)NH— group or an oxygen atom;

A represents a $(CH_2)_p$ group, p being an integer from 1 to 6, preferably from 2 to 4;

B represents a linear or branched $C_2$-$C_{12}$, advantageously $C_3$-$C_6$, polymethylene chain optionally interrupted by one or more heteroatoms or heterogroups, in particular O or NH, and optionally substituted by one or more hydroxyl or amino groups, preferably hydroxyl groups; X, which are identical or different, represent counterions; (b) at least one hydrophilic monomer carrying a functional group with an acidic nature which is copolymerizable with (a) and which is capable of being ionized in the application medium; (c) optionally at least one monomer compound with ethylenic unsaturation with a neutral charge which is copolymerizable with (a) and (b), preferably a hydrophilic monomer compound with ethylenic unsaturation with a neutral charge, carrying one or more hydrophilic groups, which is copolymerizable with (a) and (b).

Another example includes a water-soluble or water-dispersible copolymer comprising, in the form of polymerized units: (a) at least one monomer compound of general formula I:

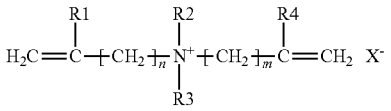

in which: $R_1$ and $R_4$, independently of each other, represent a hydrogen atom or a linear or branched $C_1$-$C_6$ alkyl group; $R_2$ and $R_3$, independently of each other, represent an alkyl, hydroxyalkyl or aminoalkyl group in which the alkyl group is a linear or branched $C_1$-$C_6$ chain, preferably a methyl group; n and m are integers between 1 and 3; X, which may be identical or different, represent counterions which are compatible with the water-soluble or water-dispersible nature of the polymer; (b) at least one hydrophilic monomer bearing a function of acidic nature which is copolymerizable with (a) and capable of ionizing in the application medium, (c) optionally, at least one hydrophilic monomer compound containing ethylenic unsaturation and of neutral charge, bearing one or more hydrophilic groups, which is copolymerizable with (a) and (b), in which the a/b molar ratio is between 60/40 and 5/95, to give a hard surface hydrophilic properties.

Preferably, $R_1$ represents hydrogen, $R_2$ represents methyl, $R_3$ represents methyl, $R_4$ represents hydrogen, and m and n are equal to 1.

The ion $X^-$ is advantageously chosen from halogen, sulfate, hydrogen sulfate, phosphate, citrate, formate and acetate.

The monomer (a) gives the copolymer properties of interaction with the surface to be treated, in particular allowing anchoring of the copolymer to this surface. The monomer (b) and optionally the monomer (c) give the copolymer hydrophilic properties which, after anchoring the copolymer to the surface to be treated, are transmitted to this surface.

This hydrophilic property of the surface moreover reduces the formation of mist on the surface; this benefit can be exploited in particular in cleaning formulations for glass panels and mirrors, in particular in bathrooms.

The copolymer advantageously has a molecular mass of at least 1000, advantageously of at least 10,000; it can be up to 20,000,000, advantageously up to 10,000,000.

Yet another example is a water-soluble or water-dispersible copolymer comprising, in the form of polymerized units: (a) at least one monomeric compound of general formula I:

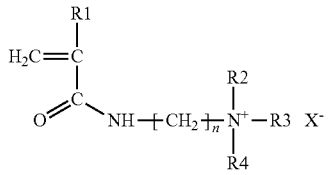

in which $R_1$ is a hydrogen atom or a methyl group, preferably a methyl group; $R_2$, $R_3$ and $R_4$ are linear or branched $C_1$-$C_4$ alkyl groups; n represents an integer from 1 to 4, in particular the number 3; X represents a counterion which is compatible with the water-soluble or water-dispersible nature of the polymer; (b) at least one hydrophilic monomer chosen from $C_3$-$C_8$ carboxylic acids containing monoethylenic unsaturation, anhydrides thereof and water-soluble salts thereof; (c) optionally at least one hydrophilic monomeric compound containing ethylenic unsaturation, of neutral charge, bearing one or more hydrophilic groups, which is copolymerizable with (a) and (b); the average charge Q on the copolymer defined by the equation:

$$Q = \frac{[a] - [b]\Gamma}{[a]}$$

in which [a] represents the molar concentration of monomer (a); in which [b] represents the molar concentration of monomer (b); and r represents the rate of neutralization of monomers (b) defined by:

$$\Gamma = \frac{[COO^-]}{[COOH] + [COO^-]}$$

in which [COOH] and $[COO^-]$ represent, respectively, the molar concentrations of monomers (b) in carboxylic acid and carboxylate form at the pH at which the cleaning composition is used, being greater than 0 and possibly going down to 0.4, advantageously down to 0.2. The molar ratio (a)/(b) is advantageously between 25/75 and 70/30. The molar ratio c/(a+b+c) is advantageously between 0 and 40/100, preferably between 10/100 and 30/100. This copolymer is preferably a random copolymer.

The average charge Q on the said copolymer at the pH of the cleaning composition may be determined by any known means, in particular by assay using a polyvinyl sulphate solution or by zetametry.

The monomer (a) gives the copolymer properties of interaction with the surface to be treated, in particular allowing anchoring of the copolymer to this surface. The monomer (b) and optionally the monomer (c) give the copolymer hydrophilic properties which, after anchoring the copolymer to the surface to be treated, are transmitted to this surface.

The copolymer has a weight-average molecular mass of at least 1000, advantageously of at least 10,000; it can be up to 20,000,000, advantageously up to 10,000,000.

The preferred monomer (a) is MAPTAC of the following formula:

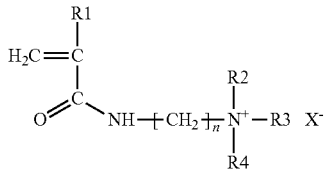

Among the preferred monomers (b) which may be mentioned are acrylic acid, methacrylic acid, α-ethacrylic acid, β, β.-dimethylacrylic acid, methylene-malonic acid, vinylacetic acid, allylacetic acid, ethylidineacetic acid, propylidineacetic acid, crotonic acid, maleic acid, fumaric acid, itaconic acid, citraconic acid, mesaconic acid, N-methacroylalanine, N-acryloylhydroxyglycine, and anhydrides and alkali metal salts and ammonium salts thereof.

Among the monomers (c) which may be mentioned are acrylamide, vinyl alcohol, $C_1$-$C_4$ alkyl esters of acrylic acid and of methacrylic acid, $C_1$-$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters.

X is any suitable counteranion which is compatible with the water-soluble or water-dispersible nature of the copolymer, in particular a halide, sulphate, hydrogen sulphate, phosphate, citrate, formate or acetate anion.

Yet another example includes a water-soluble or water-dispersible copolymer comprising, in the form of polymerized units: (a) at least one monomer compound of general formula I:

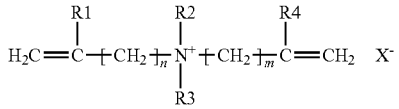

in which: $R_1$ and $R_4$, independently of each other, represent a hydrogen atom or a linear or branched $C_1$-$C_5$ alkyl group; $R_2$ and $R_3$, independently of each other, represent an alkyl, hydroxyalkyl or aminoalkyl group in which the alkyl group is a linear or branched $C_1$-$C_5$ chain, preferably a methyl group; n and m are integers between 1 and 3; X, which may be identical or different, represent counterions which are compatible with the water-soluble or water-dispersible nature of the polymer; (b) at least one hydrophilic monomer bearing a function of acidic nature which is copolymerizable with (a) and capable of ionizing in the application medium, (c) optionally, at least one hydrophilic monomer compound containing ethylenic unsaturation and of neutral charge, bearing one or more hydrophilic groups, which is copolymerizable with (a) and (b), in which the a/b molar ratio is between 60/40 and 5/95, to give a hard surface hydrophilic properties.

Preferably, $R_1$ represents hydrogen, $R_2$ represents methyl, $R_3$ represents methyl, $R_4$ represents hydrogen, and m and n are equal to 1. The ion $X^-$ is advantageously chosen from halogen, sulfate, hydrogen sulfate, phosphate, citrate, formate and acetate. The monomer (a) gives the copolymer properties of interaction with the surface to be treated, in particular allowing anchoring of the copolymer to this surface. The monomer (b) and optionally the monomer (c) give the copolymer hydrophilic properties which, after anchoring the copolymer to the surface to be treated, are transmitted to this surface.

The copolymer has a molecular mass of at least 1000, advantageously of at least 10,000; it can be up to 20,000,000, advantageously up to 10,000,000.

The copolymer is preferably a random copolymer.

The monomer (a) preferably has the following structure:

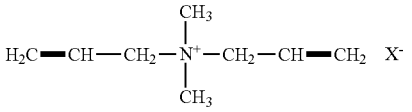

$X^-$ being as defined above.

One monomer which is particularly preferred is that of the above formula in which X– represents $Cl^-$, this monomer being known as DADMAC.

The monomers (b) are advantageously water-soluble $C_3$-$C_8$ carboxylic, sulfonic, sulfuric, phosphonic or phosphoric acids containing monoethylenic unsaturation, anhydrides thereof and water-soluble salts thereof.

Among the preferred monomers (b) which may be mentioned are acrylic acid, methacrylic acid, α-ethacrylic acid, β,β-dimethacrylic acid, methylenemalonic acid, vinylacetic acid, allylacetic acid, ethylideneacetic acid, propylideneacetic acid, crotonic acid, maleic acid, fumaric acid, itaconic acid, citraconic acid, mesaconic acid, N-meth-acryloylalanine, N-acryloylhydroxyglycine, sulfopropyl acrylate, sulfoethyl acrylate, sulfoethyl methacrylate, sulfoethyl methacrylate, styrenesulfonic acid, vinylsulfonic acid, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate and phosphonopropyl methacrylate, and the ammonium and alkali metal salts of these acids.

Among the monomers (c) which may be mentioned are acrylamide, vinyl alcohol, $C_1$-$C_4$ alkyl esters of acrylic acid and of methacrylic acid, $C_1$-$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters.

The monomer (a) content is advantageously between 5 mol % and 60 mol %, preferably 20 mol % to 50 mol %.

The monomer (b) content is advantageously between 10 mol % and 95 mol %, preferably 20 mol % to 80 mol %.

The monomer (c) content is advantageously between 0 mol % and 50 mol %, preferably 5 mol % to 30 mol %. The a/b molar ratio is preferably between 50/50 and 10/90.

Particularly suitable polymers are nitrogen-containing polymers such as quaternized ammonium acrylamide acrylic acid copolymers, e.g., diallyl dimethyl ammonium chloride/acrylamide/acrylic acid copolymer. Preferred examples of the acidic monomer (a) include acrylic acid and methylacrylic acid. A preferred example of a cationic monomer (b) is methacryl-amido(propyl)-trimethyl ammonium chloride. A preferred neutral monomer, when present, is dimethyl amidoethyl methacrylate. Commercially available hydrophilic polymers useful in the present composition are produced by Rhodia and sold under the tradename MIRAPOL SURF S. A most preferred MIRAPOL SURF S polymer is sold under the tradename MIRAPOL SURF S-210. Other suitable polymers include The Polyquart series from BASF sold under the name of PolyQuart Ampho, PolyQuart Pro, or PolyQuart Eco-Clean. Still further examples of suitable polymers include the Sokalan series of water soluble polymers from BASF including specifically Sokalon HP70.

POLYQUART AMPHO 149, is an aqueous acrylic acid polymer produced by Cognis having the chemical name N,N,N-trimethyl-3-[(2-methyl-1-oxo-2-propenyl)amino]-1-propanaminium chloride polymer with ethyl 2-propenoate and sodium propenoate. SOKALAN HP 70, is a water-soluble modified polyamine produced by BASF. SOKALAN HP 70 includes homo- or co-polymers on the basis of vinylpyrrolidone, vinylimidazole and monomers with nonionic character.

Without being limited thereto, it is believed that the cationic nature of the polymer allows the polymer to attach itself to charged sites on a high energy hard surface, such as a glass or ceramic surface. The polymer provides hydrophilic or hydrophobic characteristics to the barrier film formed on a hard surface following treatment with the composition, as well as operates in combination with the alkyl polyglycoside surfactant (as further described below) to provide the film with residual cleaning benefit for an extended period of usage. The polymer combines with the surfactant to form an enhanced film on the surface treated. The cationic surface modification polymer is present in the cleaning composition in an amount of from about 0.1 to about 65 wt. % based on solids or actives, preferably about 0.5 to about 40 wt. %, more preferably about 0.5 to about 30 wt. %, and most preferably about 0.5 to about 16 wt. %, each based on solids or actives.

The cleaning composition still further includes water. In one example, the majority of the cleaning composition can be water. In another example, the cleaning composition can include between about 20% and about 99.9%, between about 50% and about 99.9%, between about 65% and about 95%, or between about 70% and about 99.9% by weight water. In a further example, the cleaning composition includes at least about 90% water by weight of the cleaning composition. In a still further example, the cleaning composition can include at least about 91% or at least about 93% water by weight of the cleaning composition.

The water of the cleaning composition can be relatively free of hardness. In one example, the water of the cleaning composition is deionized water and is substantially free of dissolved solids. In other example, the water of the cleaning composition can be softened. Alternatively, the cleaning composition can be formed with water that has not been softened.

That is, the can be formed with water that includes dissolved solids and that may be characterized as hard water.

A cleaning composition can consist essentially of at least one alkyl polyglycoside, glycerine, a cationic polymer and water. This cleaning composition can be essentially free of organic solvents, ammonia compounds, and alkanol amines. This cleaning composition can also have a low concentration of or is essentially free of volatile organic compounds. Further, this cleaning composition can have a relatively high bio-based content.

The cleaning composition optionally includes at least one amino-carboxylate such as but not limited to salts of ethylenediamine-tetraacetic acid (EDTA) and methyl glycine diacetic acid (MGDA), and dicarboxymethyl glutamic acid tetrasodium salt (GLDA). The amino-carboxylate may also be in its acid form. Suitable commercially available MGDAs include but are not limited to Trilon® M available from BASF. Bio-based amino-carboxylates, such as GLDA, may also be used. Suitable bio-based amino-carboxylates may contain at least 40% bio-based content, at least 45% bio-based content, and more preferably, at least 50% bio-based content. For example, suitable commercially available GLDAs include but are not limited to Dissolvine® GL available from Akzo Nobel, which contains approximately 50% bio-based content.

The cleaning composition can contain a sufficient amount of the amino-carboxylate to assist with water hardness, such as hardness in the dilution water. For example, the amino-carboxylate may suspend or disperse water hardness, or total dissolved solids. Suitable concentrations of the amino-carboxylate and salts thereof in the cleaning solution include between about 0.01% and about 15% by weight of the cleaning solution. Particularly suitable concentrations of the amino-carboxylate and salts thereof in the cleaning solution include between about 0.04% and about 10% or between about 0.04% and about 7.5% by weight of the cleaning solution. The cleaning composition may contain a sufficient amount of amino-carboxylate to suspend or disperse water hardness up to about 5 grains, or approximately 85 mg/liter of calcium carbonate. High amino-carboxylate concentrations may contribute to solid build-up, which causes filming and streaking. The amino-carboxylate concentration of the cleaning composition may be designed so the use solution disperses or suspends water hardness while causing little to no solid build-up. Suitable MGDA to glycerin weight ratios include between about 10:1 and about 1:4. More suitable MGDA to glycerin weight ratios include between about 4:1 and about 1:2.

In some embodiments, polymers may also be added to the cleaning composition to assist with dispersing hardness and other non-hardness materials. Example non-hardness materials include total dissolved solids (TDS) such as sodium salts. Suitable polymers include sodium polycarboxylates, such as sodium polyacrylate, and acrylate/sulfonated co-polymers. In one example, the sodium polycarboxylate or acrylate/sulfonated co-polymer has a molecular weight less than about 100,000. In another example, the sodium polycarboxylate or acrylate/sulfonated co-polymer has a molecular weight less than about 50,000. In a further example, the sodium polycarboxylate or acrylate/sulfonated co-polymer has a molecular weight between about 5,000 and about 25,000. Suitable commercially available polymers include Acusol 460N available from Dow Chemical and Aquatreat AR-546 available from Akzo Nobel. Suitable concentrations of the polymer include between about 0% and about 10% by weight of the cleaning composition. Further suitable concentrations of the polymer include between about 0% and about 7.5% and between about 0% and about 5% by weight of the cleaning composition. The polymers can be used in combination with one another or alone.

The cleaning composition comprises an increased amount of bio-based components. Bio-based components are components that are composed, in whole or in significant part, of biological products. The amount of biological components or derivatives is referred to as bio-based content, which is the amount of bio-based carbon in the material or product expressed as a percent of weight (mass) of the total organic carbon in the material or product. Bio-based content can be determined using ASTM Method D6866, entitled Standard Test Methods for Determining the Bio-based Content of Natural Range Materials Using Radiocarbon and Isotope Ratio Mass Spectometry Analysis. More specifically, ASTM Method D6866 uses radiocarbon dating to measure the amount of new carbon present in a product as a percentage of the total organic carbon by comparing the ratio of Carbon 12 to Carbon 14. The water content of a product is not included as part of bio-based content as it contains no carbon. It is noted that bio-based content is distinct from product biodegradability. Product biodegradability measures the ability of microorganisms present in the disposal environment to completely consume the carbon components within a product within a reasonable amount of time and in a specified environment. In one example, the cleaning composition includes at least 49% bio-based content. More suitably, the composition includes at least 75%, at least 80%, at least 85%, at least 90%, or at least 95% bio-based content.

The pH of the cleaning composition may be between about 5 and about 12. More preferably, the pH of the cleaning composition may be below about 10 and above 8. In one example, it may be preferable that the cleaning composition has a pH in an alkaline range between about 8.5 to 9.5 and about 8. The pH of the cleaning composition may be adjusted as is known in the art. For example, 50% citric acid white or may be used to lower the pH of the cleaning composition while sodium hydroxide may be used to increase pH.

The cleaning composition may be substantially free of anionic surfactants such as sodium lauryl sulfate. It has been found that an anionic surfactant may have detrimental effects in the cleaning composition when water hardness is present. For example, an anionic surfactant may precipitate in the presence of water hardness. Additionally, an anionic surfactant may cause streaking in the presence of water hardness. The cleaning compositions of the present invention and the use solutions made there from provide sufficient detersivity and produces reduced streaking without the use of an anionic surfactant.

The cleaning composition may also be substantially free of polyoxypropylene-polyoxyethylene block co-polymers. It has been found that polyoxypropylene-polyoxyethylene block co-polymers may not reduce streaking and filming. In some compositions polyoxypropylene-polyoxyethylene block co-polymers may be removed from the composition without affecting the reduced streaking.

The cleaning composition may also be substantially free of organic solvents. Organic solvents such as ethanol, isopropyl alcohol, butyl glycol, typically contain volatile organic compounds and may have low bio-based content. The current cleaning composition is substantially free of organic solvents, leading to a low or zero volatile organic compound concentration and a higher bio-based content.

In contrast to many typical glass cleaners, the current cleaning composition does not require or include an organic cleaning solvent for soil removal. Although the current cleaning composition is solvent free, it does include glycerine as a glide aid. Glycerine is highly water soluble, making it a very poor solvent. Glycerine functions as a glide aid, helping a cloth slide across the surface being cleaned and resulting in smoothing streaking as the cloth is wiped across the surface.

Additionally, in contrast to many previous glass cleaners, the current cleaning composition may be substantially free of ammonia compounds and alkanol amines. Ammonia compounds are typically added to glass cleaners as an alkalinity source to help break up stains and because they evaporate relatively quickly. Example ammonia compounds include but are not limited to ammonium carbonate, ammonium bicarbonate, ammonium hydroxide, ammonium acetate, ammonium borate, ammonium phosphate, and ammonium. Alkanol amines, such as monoethanolamine, a derivative of ammonia, are also substantially not included in the current cleaning composition.

The cleaning composition also does not have a cloud point. Cloud point is the temperature at which a compound will precipitate out of solution. Some compounds decrease in solubility as the temperature of the solution increases. As the temperature approaches the cloud point, the surfactant molecules coagulate into clusters, called micelles. At the cloud point, the micelles reach a size so large that they interfere with the passage of light through the solution, which is observed as cloudiness in the solution. The cloud point may be determined by heating a solution until it becomes cloudy, and then allowing the solution to cool and measuring the temperature of the solution when it becomes clear. The compounds which cause the cloud point may also contribute to streaking, haziness and/or solids build-up on the substrate. The haziness and streaking may be particularly noticeable when the cleaning composition is applied to substrates which are exposed to elevated temperatures, such as windows in direct sunlight. It has been found that cleaning compositions that are substantially free of polyoxypropylene-polyoxyethylene block copolymers do not have a cloud point. Thus, polyoxypropylene-polyoxyethylene block co-polymers may contribute to the cloud point.

Additional Functional Materials

The cleaning composition may contain other functional materials that provide desired properties and functionalities to the cleaning composition. For the purposes of this application, the term "functional materials" includes a material that when dispersed or dissolved in a use solution/concentrate solution, such as an aqueous solution, provides a beneficial property in a particular use. Examples of functional materials include but are not limited to: aqueous compatible solvents, sequestrants, surface chemistry modifiers, preservatives, defoaming agents, metal protectors, dyes/odorants, and microbiocides. In one embodiment, the cleaning composition consists essentially of water, glycerine, at least one alkyl polyglycoside, and optionally one member selected from the group consisting of: sodium polycarboxylates, acrylic/sulfonated co-polymers, anti-mist components, stability agents, amino carboxylates, dyes, fragrances, preservatives, and defoaming agents. It is noted that certain functional materials, such as dyes, fragrances, preservatives and defoaming agents may contain low concentrations of organic solvents, ammonia compounds, alkanol amines, and/or VOCs. These functional materials may be present at low concentrations (i.e., less than 1 wt. %) in concentrate cleaning compositions and use solutions that are essentially free of organic solvents, ammonia compounds, alkanol amines, and/or VOCs.

Glass and Metal Corrosion Inhibitors

The detergent composition can include a metal corrosion inhibitor in an amount up to approximately 50% by weight, between approximately 1% and approximately 40% by weight, or between approximately 3% and approximately 30% by weight. The corrosion inhibitor is included in the detergent composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. The use solution can include between approximately 6 ppm and approximately 300 ppm of the corrosion inhibitor, and between approximately 20 ppm and approximately 200 ppm of the corrosion inhibitor. Examples of suitable corrosion inhibitors include, but are not limited to: a combination of a source of aluminum ion and a source of zinc ion, as well as an alkaline metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof.

Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, and aluminum zinc sulfate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

Aqueous Compatible Solvents

Although preferably the cleaning composition is free of organic solvents, it may optionally include a compatible solvent. Suitable solvents are soluble in the aqueous cleaning composition of the invention at use proportions. Preferred soluble solvents include lower alkanols, lower alkyl ethers, and lower alkyl glycol ethers. These materials are colorless liquids with mild pleasant odors, are excellent solvents and coupling agents and are typically miscible with aqueous cleaning compositions of the invention. Examples of such useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers. The glycol ethers include lower alkyl ($C_{1-8}$ alkyl)ethers including propylene glycol methyl ether, propylene glycol ethyl ether, propylene glycol propyl ether, dipropylene glycol methyl ether, dipropylene glycol ethyl ether, tripropylene glycol methyl ether, ethylene glycol methyl ether, ethylene glycol ethyl ether, ethylene glycol butyl ether, diethylene glycol methyl ether, diethylene glycol butyl ether, ethylene glycol dimethyl ether, ethylene glycol monobutyl ether, and others. The solvent capacity of the cleaners can be augmented by using monoalkanol amines.

Sequestrants

The cleaning composition can contain an organic or inorganic sequestrant or mixtures of sequestrants. Organic sequestrants such as citric acid, the alkali metal salts of nitrilotriacetic acid (NTA), EDTA, alkali metal gluconates, polyelectrolytes such as a polyacrylic acid, sodium gluconate, and the like can be used herein.

The cleaning composition can also comprise an effective amount of a water-soluble organic phosphonic acid which has sequestering properties. Preferred phosphonic acids include low molecular weight compounds containing at least two anion-forming groups, at least one of which is a phosphonic acid group. Such useful phosphonic acids include mono-, di-, tri- and tetra-phosphonic acids which can also contain groups capable of forming anions under alkaline conditions such as carboxy, hydroxy, thio and the like.

Among these are phosphonic acids having the formulae: $R_1N[CH_2PO_3H_2]_2$ or $R_2C(PO_3H_2)_2OH$, wherein $R_1$ may be -[(lower)alkylene]$N[CH_2PO_3H_2]_2$ or a third —$CH_2PO_3H_2$ moiety; and wherein $R_2$ is selected from the group consisting of $C_1C_6$ alkyl.

The phosphonic acid may also comprise a low molecular weight phosphonopolycarboxylic acid such as one having about 2-4 carboxylic acid moieties and about 1-3 phosphonic acid groups. Such acids include 1-phosphono-1 methylsuccinc acid, phosphonosuccinic acid and 2-phosphonobutane-1,2,4-tricarboxylic acid.

Other organic phosphonic acids include 1-hydroxyethylidene-1,1-diphosphonic acid ($CH_3C(PO_3H_2)_2OH$), available from ThermPhos as Dequest® 2010, a 58-62% aqueous solution; amino [tri(methylenephosphonic acid)] ($N[CH_2PO_3H_2]_3$), available from ThermPhos as Dequest® 2000, a 50% aqueous solution; ethylenediamine [tetra(methylene-phosphonic acid)] available from ThermPhos as Dequest® 2041, a 90% solid acid product; and 2-phosphonobutane-1,2,4-tricarboxylic acid available from Lanxess as Bayhibit AM, a 45-50% aqueous solution. It will be appreciated that, the above-mentioned phosphonic acids can also be used in the form of water-soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used. Further useful phosphonic acids are disclosed in U.S. Pat. No. 4,051,058, the disclosure of which is incorporated by reference herein.

The cleaning composition can also incorporate a water soluble acrylic polymer which can act to condition the use solutions under end-use conditions. Such polymers include polyacrylic acid, polymethacrylic acid, acrylic acid-methacrylic acid copolymers, hydrolyzed polyacrylamide, hydrolyzed polymethacrylamide, hydrolyzed acrylamide methacrylamide copolymers, hydrolyzed polyacrylonitrile, hydrolyzed polymethacrylonitrile, hydrolyzed acrylonitrile methacrylonitrile copolymers, or mixtures thereof. Water-soluble salts or partial salts of these polymers such as the respective alkali metal (e.g. sodium or potassium) or ammonium salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 6,000. These polymers are commercially available, and methods for their preparation are well-known in the art.

For example, commercially-available water-conditioning polyacrylate solutions useful in the present cleaning solutions include the sodium polyacrylate solution, Colloid® 207 (Colloids, Inc., Newark, N.J.); the polyacrylic acid solution, Aquatreat®AR-602-A (Alco Chemical Corp., Chattanooga, Tenn.); the polyacrylic acid solutions (50-65% solids) and the sodium polyacrylate powders (m.w. 2,100 and 6,000) and solutions (45% solids) available as the Goodrite®° K-700 series from B. F. Goodrich Co.; and the sodium- or partial sodium salts of polyacrylic acid solutions (m.w. 1000-4500) available as the Acrysol® series from Dow Chemical.

The present cleaning composition can also incorporate sequestrants to include materials such as, complex phosphate sequestrants, including sodium tripolyphosphate, sodium hexametaphosphate, and the like, as well as mixtures thereof. Phosphates, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 to 2:1 and greater. Typical polyphosphates of this kind are the preferred sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

Sodium tripolyphosphate is another inorganic hardness sequestering agent. Sodium tripolyphosphate acts to sequester calcium and/or magnesium cations, providing water softening properties. It contributes to the removal of soil from hard surfaces and keeps soil in suspension. It has little corrosive action on common surface materials and is low in cost compared to other water conditioners. Sodium tripolyphosphate has relatively low solubility in water (about 14 wt. %) and its concentration must be increased using means other than solubility. Typical examples of such phosphates being alkaline condensed phosphates (i.e., polyphosphates) such as sodium or potassium pyrophosphate, sodium or potassium tripolyphosphate, sodium or potassium hexametaphosphate, etc.

Surface Chemistry Modifiers

Various surface chemistry modifiers can be incorporated into the cleaning composition. Examples of suitable commercially available surface chemistry modifiers include Laponite® silicates available from Southern Clay Products, Inc. The surface chemistry modifiers may have high surface free energy and high surface area which leads to interactions with many types of organic compounds. In one example, suitable surface chemistry modifiers have a surface free energy of about 200 mjoules/meter$^2$ and a surface area of between about 750 and 800 m$^2$/gram. A suitable concentration range for surface chemistry modifiers in the use solution is between about 10 ppm and about 100 ppm.

Preservatives

The cleaning composition can include effective amounts of preservatives. The preservatives may serve a preservative and stabilizing function. When the cleaning composition includes a preservative, the preservative can be provided in amount of between about 0.001 wt. % and about 1 wt. %.

Example preservatives include but are not limited to methylchloroisothiazolinone (CMIT), methylisothiazolinone (MIT), glutaraldehyde, 1,2-benzisothiazoline-3-one (BIT), polyhexamethylenebiguanide hydrochloride (PHMB), phenoxyethanol, methylparaben, propyl P-hydroxybenzoate (propyl paraben) and sodium benzoate NF dense. Another suitable preservative is Neolone™ M-10, a 9.5% active preservative available from Dow.

Defoaming Agent

The cleaning composition can include a defoaming agent to reduce the stability of foam and reduce foaming. When the cleaning composition includes a defoaming agent, the defoaming agent can be provided in an amount of between about 0.0001 wt. % and about 3 wt. %.

Examples of defoaming agents that can be used in the composition includes silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. Antifoam B, a 10% active water dilutable silicone emulsion available from Dow Corning, is another suitable defoaming agent. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein for all purposes.

Metal Protectors

The cleaning composition can contain a material that can protect metal from corrosion. Such metal protectors include for example sodium gluconate and sodium glucoheptonate.

Dyes/Odorants

Various dyes, odorants including perfumes, and other aesthetic enhancing agents may also be included in the detergent compositions. Examples of suitable commercially available dyes include, but are not limited to: Direct Blue 86, available from Mac Dye-Chem Industries, Ahmedabad, India; Fastusol Blue, available from BASF; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keystone Aniline and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Examples of suitable fragrances or perfumes include, but are not limited to: terpenoids such as citronellol, aldehydes such as amyl cinnamaldehyde, a jasmine such as C1S-jasmine or jasmal, and vanillin.

Anti-Mist Components and Stability Agents

The cleaning composition may optionally include an anti-mist component to reduce aerosol misting and increase droplet size when the cleaning composition is dispersed with a trigger sprayer. Among other benefits, reduced aerosol misting results in a greater amount of the use solution reaching the intended surface or substrate and a spray pattern with less aerosol at the edges.

Suitable anti-mist components include polyethylene oxide, polyacrylamide, and combinations thereof. PEO is a high molecular weight polymer. A suitable PEO can have a molecular weight between about 3,000,000 and about 7,000,000. One commercially available PEO is Polyox WSR 301, which has a molecular weight of about 4 million and is available from Dow. A suitable polyacrylamide can have a molecular weight between about 8 million and about 16 million, and more suitably between about 11 million and about 13 million. One commercially available polyacrylamide is SuperFloc® N-300 available from Kemira Water Solutions, Inc.

Suitable concentration ranges for polyethylene oxide, polyacrylamide and combinations thereof in the cleaning composition are between about 0.01% and about 3.0% by weight of the cleaning composition. Further suitable concentration ranges for polyethylene oxide, polyacrylamide and combinations thereof in the cleaning composition are between about 0.01% and 1.2% or between about 0.01% and 0.3% by weight of the cleaning composition.

The anti-mist component is chosen such that the resulting cleaning composition is a non-Newtonian fluid. Non-Newtonian fluids have a short relaxation time and have a direct correlation between shear and elongational viscosity (the elongational viscosity of the fluid equals three times the shear viscosity). Shear viscosity is a measure of a fluid's ability to resist the movement of layers relative to each other. Elongational viscosity, which is also known as extensional viscosity, is measure of a fluid's ability to stretch elastically under elongational stress. Non-Newtonian fluids do not have a direct correlation between shear and elongational viscosity and are able to store elastic energy when under strain, giving exponentially more elongational than shear viscosity and producing an effect of thickening under strain (i.e., shear thickening). The properties of a non-Newtonian fluid result in a cleaning composition use solution that has a low viscosity when not under shear but that thickens when under stress from the trigger sprayer. For example, the mean particle size of the dispensed cleaning composition can be about 11 microns or greater. A particularly suitable median particle size is about 50 microns or greater. A more particularly suitable median particle size is about 70 microns or greater, about 100 microns or greater, about 150 microns or greater, or about 200 microns or greater. Even at high anti-mist component concentration levels, such as those of the cleaning composition, the cleaning composition has a viscosity similar to that of water when not under strain.

The effectiveness of an anti-mist component to reduce misting and increase droplet size may degrade over time. A stability component may reduce degradation of the anti-mist component and improve the shelf-life of the cleaning composition. Suitable stability components may include antioxidants, chelants, propylene glycol and glycerine. Example antioxidants include, but are not limited to, Irganox® 5057, a liquid aromatic amine antioxidant, Irganox® 1135, a liquid hindered phenolic antioxidant, Tinogard® NOA, and Irgafos® 168, all available from BASF. Additional example antioxidants include vitamin E acetate. Example chelants include, but are not limited to, Dissolvine® GL-47-S, tetrasodium glutamate diacetate, and Dissolvine® GL-38, glutamic acid, N,N-diacetic acid, tetra sodium salt, both available from Akzo Nobel. A suitable concentration range of the stability components includes between approximately 100 parts per million (ppm) and approximately 50,000 ppm of the cleaning composition or between approximately 0.01% and 5% by weight. A further suitable concentration range of the stability components includes between approximately 100 ppm and approximately 200,000 ppm.

The cleaning compositions may include a combination of stability components, which may further improve the stability of the composition. For example, the cleaning compositions may include a combination of two or more stability components. In one example, the cleaning composition may include an antioxidant and a chelant. In a further example the cleaning composition may include Irganox® 1135 and Dissolvine® GL-47-S. Synergist effects have been observed when Irganox® 1135 and Dissolvine® GL-47-S are used in combination. For example, it has been found that when combined the total effect amount of Irganox® 1135 and Dissolvine® GL-47-S is half of that when each when used alone. Suitable anti-mist components, compositions containing anti-mist components and methods of use are also disclosed in the provisional application entitled "Development of Extensional Viscosity for Reduced Atomization for Diluted Sprayer Applications" U.S. Publication No. 2013/0255729 which was filed on even date and which is incorporated by reference herein.

As discussed further below, the cleaning solution may be diluted with water to form a use solution. The resulting use solution has a relatively low anti-mist component concentration. In one suitable use solution, the concentration of PEO is between about 0.002% and about 0.006% or between about 0.003% and 0.005% by weight of the use solution. In another suitable use solution, the polyacrylamide concentration is between about 0.002% and 0.01% by weight, and particularly between about 0.003% and about 0.007% by weight of the use solution. In a further suitable use solution, the concentration of PEO, PAA or a combination thereof is between about 0.002% and about 0.006% by weight, and particularly between about 0.003% and 0.005% by weight of the use solution.

The resulting use solution can also have a relative low stability component concentration. In one suitable use solution, the stability component concentration is between about 0.003% and about 7% by weight of the use solution.

The use solution can be dispensed with a standard transient trigger sprayer or a low velocity trigger sprayer, such as those available from Calmar. A typical transient trigger sprayer includes a discharge valve at the nozzle end of the discharge end of a discharge passage. A resilient member, such as a spring, keeps the discharge valve seated in a closed position. When the fluid pressure in the discharge valve is greater than the force of the resilient member, the discharge valve opens and disperses the fluid. A typical discharge valve on a stock trigger sprayer is a throttling valve which allows the user to control the actuation rate of the trigger sprayer. The actuation rate of the discharge valve determines the flow velocity, and a greater velocity results in smaller droplets. A low velocity trigger sprayer can contain a two-stage pressure build-up discharge valve assembly which regulates the operator's pumping stroke velocity and produces a well-defined particle size. In one example, the two-stage pressure build-up discharge valve can include a first valve having a high pressure threshold and a second valve having a lower pressure threshold so that the discharge valve snaps open and closed at the beginning and end of the pumping process. Example low-velocity trigger sprayers are commercially available from Calmar and are described in U.S. Pat. No. 5,522,547 to Dobbs and U.S. Pat. No. 7,775,405 to Sweeton which are incorporated herein in their entirety. The low velocity trigger sprayers may result in less drifting, misting and atomization of the use solution, and may reduce the amount of small droplets dispensed. The cleaning composition containing an antimist component may work in synergy with the low velocity trigger sprayer to produce a greater increase in droplet size than expect based on the components alone.

Use Solution

The cleaning composition can be diluted to provide a ready to use cleaning composition. In addition, the ready to use detergent composition can be further diluted to provide the use solution that is intended to be used to clean a surface. The ready to use composition can be referred to as the use solution when it is the solution that is intended to be used to provide cleaning of a surface. For example, in the case of a glass cleaner, the ready to use solution can be applied to the surface without further dilution and may be referred to as the use solution. Additionally, when cleaning hard surfaces, such as glass surfaces, it may be desirable to dilute the ready to use solution and clean the hard surface with the resulting use solution.

The cleaning composition can be provided as a concentrate for shipment to distributors or end users. The concentrate may then be diluted by the distributor or end user to provide a less concentrated cleaning composition and/or a ready to use cleaning composition.

Because the cleaning composition may be supplied as a concentrate, the cleaning composition may be diluted with the water available at the locale or site of dilution. It is recognized that the level of water hardness changes from one locale to another. Accordingly, the concentrate may be diluted with water having varying amounts of hardness depending on the locale or site of dilution. In general, water hardness refers to the presence of calcium, magnesium, iron, manganese, and other polyvalent metal cations that may be present in the water, and it is understood that the level of water hardness varies from municipality to municipality. Water hardness can be characterized by the unit "grain" where one grain water hardness is equivalent to 17.1 ppm hardness expressed as $CaCO_3$, and hard water is characterized as having at least 10 grains of hardness. For example, water is commonly available having at least 5 grains hardness, at least 10 grains hardness, and at least 20 grains hardness. The concentrate cleaning solution is formulated to handle differing water hardness levels found in varying locations without having to soften the water or remove the hardness from the water.

In one example, the concentrate cleaning solution is diluted with water to form a use solution containing between about 2% and about 8% by weight concentrate cleaning solution. One suitable use solution contains between about 200 ppm and about 600 ppm of at least on amino-carboxylate, between about 75 ppm and about 800 ppm glycerine, and between about 2,000 ppm and about 4,000 ppm of at least one alkyl polyglycoside. A more particularly suitable use solution contains between about 300 ppm and about 500 ppm of at least one amino-carboxylate, between about 100 ppm and about 700 ppm glycerine, and between about 2,500 ppm and about 3,500 ppm of at least one alkyl polyglycoside.

The use solution has a relatively low volatile organic compound (VOC) content, and preferably does not contain VOCs. VOCs have been the subject of regulation by different government entities, the most prominent regulations having been established by the California Air Resource Board in its General Consumer Products Regulation. A compound is non-volatile if its vapor pressure is below 0.1 mm Hg at 20° C. Example compounds classified as a VOC include solvents such as but are not limited to acetone, ethanol, and propanol. Many cleaning compositions include organic solvents and/or VOCs to aid in water removal as a result of an azeotroping effect. The current use solution does not include an organic solvent or VOC content to assist in drying when the solution is applied to a hard surface. A suitable VOC content of the use solution includes less than about 3% VOCs by weight of the use solution, less than about 1% VOCs by weight of the use solution, or about 0% VOCs by weight of the use solution.

The use solution also has a relatively high bio-based content. As discussed above, water is excluded from the bio-based content calculation. Thus, the use solution has the same bio-based content as the cleaning composition. In one example, the use solution includes at least 49% bio-based content. More suitably, the use solution includes at least 75%, at least 80%, at least 85%, at least 90%, or at least 95% bio-based content.

Embodiments

The present invention relates to cleaning composition which can be diluted with dilution water to provide a use solution. Exemplary ranges for components of the cleaning compositions are shown in Table 1.

TABLE 1

| | Compositions | | | |
|---|---|---|---|---|
| Component | First example range (wt. %) | Second example range (wt. %) | Third example range (wt. %) | Fourth example range (wt. %) |
| Water | 20-99.9 | 50-99.9 | 65-99.9 | 70-99.9 |
| Glycerine | 0.01-10 | 0.01-8 | 0.01-6 | 0.01-2 |
| Alkyl polyglycoside | 0.2-50 | 0.2-40 | 0.2-30 | 0.2-20 |
| Amino-carboxylate | 0.04-15 | 0.04-10 | 0.04-7.5 | 0.04-3 |
| sodium polycarboxylates | 0-10 | 0-7.5 | 0-5 | 0.02-2 |
| Surface modification polymer | 0.5-65 | 0.5-40 | 0.5-30 | 0.5-16 |

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight basis, and all reagents used in the examples were obtained or are available from the chemical suppliers described below or may be synthesized by conventional techniques.

Materials Used

Glucopon® 215 UP: $C_8$-$C_{10}$ alkyl polyglycosides (63.5% active) available from BASF.

Glycerine: 96% active, available from VVF Illinois Services

Mirapol Surf-S 110 a cationic hydrophilic polymer available from Rhodia

Mirapol Surf-S 210 a cationic hydrophilic polymer available from Rhodia

Acusol™ 460N: a sodium polycarboxylate (25% active) available from Dow Chemical.

Trilon® M: sodium methyl glycine di-acetate (40% active) available from BASF

Formulations Tested

Mirapol Surf-S 110—Low 0.01-2% glycerine 0.2-20% Glucopon 215 UP (alkyl polyglucoside) (63.5%)

0.5-16%% Mirapol Surf-S 110 (hydrophilic surface modification polymer) (20%) Remainder DI water, dye and fragrance Mirapol Surf-S 210—Low Same as previous, but with Mirapol Surf-S210

Scanner/PFA Glass Cleaning Test Method

Materials:

LED Scanner; Epson Perfection V600 Photo Scanner 12"×12" Tile Mirrors; (Stanley Home Décor Innovations, EDP #20-1010, Item #P1212-NT, 3 mm thick, Plain Edge)

Preval Sprayer, for soil application; Precision Valve Corp; Balance

PFA—Precision Force Applicator Cleaning Instrument

Cheese Cloth; VWR Cat #21910-105, 60 Wipes-18×36 inches

Small Hand-held Fine sprayer, for cleaning product application; Mark VI 24MM (Mark VI 24-410 WHT 0767 16CC Finished Length 6") MeadWestvaco Calmar Inc.

Ecolab-Glass Force RTU, PIC-25798: SC Johnson—Windex Original RTU

Glass Soil:

Synthetic Sebum, mineral Oil, Mineral Sprits, Mineral Spirits, Acetone,

Clay Kaopaque 10S, Titanium Dioxide.

Test Overview

Precision Force Applicator Cleaning Test

The precision force applicator (PFA) cleaning test was designed to compare the cleaning efficiency of cleaners. First, clean 12"×12" glass mirrors were scanned with an Epson Perfection V600 Photo Scanner to determine the initial reflectance value of each mirror. The glass mirrors were 12"×12" Stanley Basics Mirror Tiles, 3 mm thick with a plain edge.

Next, a synthetic sebum formula was formed by mixing 10% palmitic acid, 5% stearic acid, 15% coconut oil, 10% paraffin wax, 15% spermaceti, 20% olive oil, 5% squalene, 5% cholesterol, 10% oleic acid, and 5% linoleic acid.

The synthetic sebum formula was mixed with mineral oil and mineral spirits using a stir bar in a small bottle. Once the synthetic sebum dissolved, acetone, clay and titanium dioxide were added in turn, with the bottle being capped between additions. The completed glass soil mixture comprised: 0.50% synthetic sebum, 0.5% mineral oil, 49.25% mineral spirits, 49.25% acetone, 0.25% clay Kaopaque, and 0.25% titanium dioxide.

The glass soil mixture was placed in a Preval Sprayer, available from Precision Valve Corp., without the stir bar. The glass soil mixture was sprayed in a serpentine pattern onto a clean glass mirror from a distance of 1 foot with four evenly applied passes. The application began at a location 2 inches from the top horizontal edge and 2 inches from the left vertical edge and moved horizontally across the mirror until 2 inches beyond the right vertical edge. The serpentine pattern was continued until reaching the bottom of the mirror.

The mirror was placed the middle shelf in a preheated 50° C. oven for 1 minute. The mirror was then removed from the oven, rotated 90 degrees, and the soil mixture was applied to the mirror in the serpentine pattern described above. The mirror was returned to the oven for 1 minute. After the second 1 minute oven storage cycle, the 90 degree rotation, soil mixture application, and oven storage cycle was completed one more time, for a total of three soil mixture applications.

The soiled mirrors were stored at room temperature until all the mirrors had been prepared for the testing. Once all the mirrors were soiled, the soiled mirrors were placed in the 50° C. oven for 2 hours. After 2 hours, the soiled mirrors were removed and allowed to cool. A plastic bag is placed over the racked mirrors to prevent dust accumulation.

The mirrors are stored at room temperature for between 24 and 48 hours. Then the soiled mirrors are scanned using the Epson Perfection V600 Photo Scanner.

After the soiled mirrors had been scanned, the mirrors were cleaned with a precision force applicator cleaning instrument (PFA). A 9"×9" cheese cloth wipe was folded into fourths and placed into the cloth holder of the PFA. The cloth holder is attached to a carriage arm on the PFA. A soiled mirror was placed on the PFA and held in place by PFA side holders. Underlayment was used so that the mirror and the PFA side holders are the same height.

The sample was sprayed onto the top half of the mirror and a 12" cardboard was used to protect the other half of the mirror from the spray test. The sample was applied evenly to the mirror in 9 spritzes (about 1.35 grams of sample). Within 60 seconds (dwell time), the mirror was positioned on the PFA by sliding the mirror flush with the top of the carriage, the side holders were tightened against the mirror and the PFA carriage containing the cheese cloth was adjusted to apply 1 lb. normal force (NF) pressure on the mirror. At the end of the dwell time, the PFA carriage arm moved across the mirror surface so that the cheese cloth slid across the mirror surface and stopped on the glass side holder on the opposite side of the mirror. The cheese cloth was removed from the PFA and the PFA applicator was cleaned from any test cleaner residue with de-ionized water applied to a paper towel. The carriage arm was repositioned to −8.5 inches. A new cheese cloth was attached to the carriage arm, the sample was applied to the portion of the mirror now aligned with the carriage arm, and the PFA slid across this new portion of the mirror as described above. The cheese cloth application and mirror placement/cleaning steps were repeated until the PFA had moved across the entire top half of the mirror. The cleaned mirrors were scanned a final time with the Epson Perfection V600 Photo Scanner.

The scanned images of the initial mirrors, soiled mirrors and cleaned mirrors were analyzed with the imaging software "National Instrument Vision Builder AI 2009" to determine the intensity of each initial, soiled and cleaned mirror. The samples were tested in duplicate, and the average value and standard deviation for each sample was calculated. A lower cleaned average intensity indicates a better cleaning efficiency.

| | Sample 1 | Sample 2 | Sample 3 | Sample 4 | Sample 5 |
|---|---|---|---|---|---|
| DI Water | | 85-99.9 | 85-99.9 | 85-99.9 | 85-99.9 |
| 5 grain water | 100 | | | | |
| Acusol 460N (sodium polycarboxylate) | | 0.01-5 | 0.01-5 | 0.01-5 | 0.01-5 |
| Trilon M (amino carboxylate) | | 0.01-2 | 0.01-2 | 0.01-2 | 0.01-2 |
| Glycerine | | 0.01-2 | 0.01-2 | 0.01-2 | 0.01-2 |
| Glucopon 215 UP (alkyl polyglucoside) | | 0.2-20 | 0.2-20 | 0.2-20 | 0.2-20 |
| Mirapol S-110 (surface modification polymer) | | | 0.5 | 0.5 | |
| Mirapol S-210 (surface modification polymer) | | | | | 0.5 |
| Final pH | 7 | 9 | 5 | 9 | 9 |

Reporting Test Results

| | Cleaned | | Pre-Treated Cleaned | | Change in Cleaning |
|---|---|---|---|---|---|
| | Average | St. Dev | Average | St. Dev | Performance |
| Sample 1 | 134.39 | 9.66 | 130.55 | 9.45 | 3.84 |
| Sample 2 | 109.80 | 4.76 | 96.27 | 11.32 | 13.53 |
| Sample 3 | 102.17 | 19.11 | 68.52 | 10.61 | 33.65 |

-continued

| | Cleaned | | Pre-Treated Cleaned | | Change in Cleaning |
|---|---|---|---|---|---|
| | Average | St. Dev | Average | St. Dev | Performance |
| Sample 4 | 97.83 | 20.56 | 48.70 | 11.46 | 49.13 |
| Sample 5 | 77.16 | 8.28 | 67.90 | 12.19 | 9.26 |
| Control (Windex) | 111.09 | 13.86 | 78.86 | 7.47 | 32.23 |

The scanner glass cleaner test method was carried out as written with the exception of pre-treatment of some of the mirrors with the solutions containing the surface modification polymers. The pre-treated mirrors were then soiled and cleaned according to the method.

This glass cleaner test method uses a scanner and image analysis software to analyze the cleaned mirrors. A lower cleaned average intensity number means a cleaner mirror. A graph of the data can be seen as FIG. 1 As can be seen in the graph pre-treatment of the mirrors with solutions containing the surface modification polymers does lower the average cleaned intensity and does so considerable with the S-110 polymer at a pH of 9. The difference in non-treated versus pre-treated mirror for the S-110 polymer at pH of 9 was 49.13 and the difference in non-treated versus pre-treated mirror for Windex was 32.23.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A cleaning composition comprising:

water in an amount of greater than about 50% by weight of the cleaning composition;

glycerine in an amount of between about 0.01% and about 8% by weight of the cleaning composition; and at least one alkyl polyglycoside in an amount of between about 0.2% and about 40% by weight of the cleaning composition, wherein the cleaning composition has a bio-based content of at least about 75%, and a cationic, hydrophilic polyampholyte surface modification polymer in an amount of from about 0.05% to about 40%.

2. The cleaning composition of claim 1 and further comprising:

at least one amino-carboxylate in an amount of between about 0.04% and about 10% by weight of the cleaning composition.

3. The cleaning composition of claim 2, wherein the at least one amino-carboxylate is selected from the group consisting of: salts of ethylenediamine-tetraacetic acid and methyl glycine di-acetic acid, and dicarboxymethyl glutamic acid tetra-sodium salt.

4. The cleaning composition of claim 1 and further comprising:

at least one sodium polycarboxylate copolymer in an amount of between about 0.01% and about 7.5% by weight of the cleaning composition.

5. The cleaning composition of claim 1 and further comprising:

at least one acrylic/sulfonated co-polymer in an amount of between about 0.01% and about 7.5% by weight of the cleaning composition.

6. The cleaning composition of claim 1, wherein the at least one alkyl polyglycoside includes a C8 to C12 alkyl polyglycoside.

7. The cleaning composition of claim 1 wherein said surface modification polymer is present in an amount of from about 0.23 to about 2.5.

8. The cleaning composition of claim 1 and further comprising:

between about 0.01% and about 0.3% polyethylene oxide, polyacrylamide or combinations thereof by weight of the cleaning composition.

9. The cleaning composition of claim 1, wherein the alkyl polyglycoside is an alkyl polyglucoside.

10. The cleaning composition of claim 1, wherein the alkyl polyglycoside is an alkyl polypentoside.

11. The cleaning composition of claim 1 consisting essentially of:

water;

at least one of glycerine or propylene glycol;

at least one alkyl polyglycoside;

at least one amino-carboxylate in an amount of between about 0.05% and about 5% by weight of the cleaning composition; and a cationic, hydrophilic polyampholyte surface modification polymer.

12. A method of using a cleaning composition use solution, the method comprising:

applying a cleaning composition use solution to a hard surface, the cleaning composition use solution comprising water, a cationic, hydrophilic polyampholyte surface modification polymer, between about 75 ppm and about 800 ppm of at least one of glycerine or propylene glycol, between about 2,000 ppm and about 4,000 ppm of at least one alkyl polyglycoside, and between about 20 ppm and about 60 ppm of at least one of polyethylene oxide and polyacrylamide; and wiping the hard surface to remove the cleaning composition use solution.

13. The method of claim 12, wherein the cleaning composition use solution further comprises between about 200 ppm and about 600 ppm of at least one amino-carboxylate.

14. The method of claim 13, wherein the cleaning composition use solution further comprises at least one member selected from the group consisting of sodium polycarboxylate copolymers and acrylic/sulfonated co-polymers.

15. The method of claim 13, wherein the cleaning composition use solution does not contain polyoxypropylene-polyoxyethylene block co-polymers or anionic surfactants.

16. A method of forming a use solution, the method comprising:

mixing dilution water with a cleaning composition to form a use solution, wherein the cleaning composition comprises at least 65% water by weight of the cleaning composition, between about 0.05% and about 8% glycerine or propylene glycol by weight of the cleaning composition, and between about 1% and about 25% at least one alkyl polyglycoside by weight of the cleaning composition, and between about 0.2% and about 16% a cationic, hydrophilic polyampholyte surface modification polymer;

wherein the cleaning composition use solution has a bio-based content of at least 75%, and wherein the use solution has a concentration of volatile organic compounds of not more than about 3%.

17. The method of claim 16, wherein the cleaning composition further comprises between about 0.05% and about 5% of at least one amino-carboxylate by weight of the cleaning composition.

18. The method of claim 16, wherein the dilution water has a hardness of at least about 5 grains.

19. The method of claim 16, wherein the cleaning composition further comprises at least one member selected from the group consisting of sodium polycarboxylate copolymers and acrylic/sulfonated co-polymers.

20. The method of claim 16, wherein the cleaning composition does not contain polyoxypropylene-polyoxyethylene block co-polymers or anionic surfactants.

* * * * *

UNITED STATES PATENT AND TRADEMARK OFFICE

CERTIFICATE OF CORRECTION

PATENT NO. : 8,641,827 B2
APPLICATION NO. : 13/662686
DATED : February 4, 2014
INVENTOR(S) : Blattner et al.

It is certified that error appears in the above-identified patent and that said Letters Patent is hereby corrected as shown below:

On the Title Page, Item (57) Abstract, Line 3:

DELETE: after acts to "provides"
ADD: after acts to --provide--

Signed and Sealed this
Thirteenth Day of May, 2014

Michelle K. Lee

Michelle K. Lee
*Deputy Director of the United States Patent and Trademark Office*